US010850422B2

(12) United States Patent
Mårtensson et al.

(10) Patent No.: US 10,850,422 B2
(45) Date of Patent: Dec. 1, 2020

(54) CUTTING SYSTEM, AND A METHOD FOR CUTTING A WEB OR SHEET OF MATERIAL

(71) Applicant: Tetra Laval Holdings & Finance S.A., Pully (CH)

(72) Inventors: Ulf Mårtensson, Köpingebro (SE); Seppo Bergman; Dan Robertsson, Tomelilla (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/302,041

(22) PCT Filed: May 15, 2017

(86) PCT No.: PCT/EP2017/061618
§ 371 (c)(1),
(2) Date: Nov. 15, 2018

(87) PCT Pub. No.: WO2017/198622
PCT Pub. Date: Nov. 23, 2017

(65) Prior Publication Data

US 2019/0152087 A1 May 23, 2019

(30) Foreign Application Priority Data

May 16, 2016 (EP) ..... 16169772

(51) Int. Cl.
*B26F 1/38* (2006.01)
*B26F 1/14* (2006.01)
(Continued)

(52) U.S. Cl.
CPC ..... *B26F 1/384* (2013.01); *B26F 1/14* (2013.01); *B26F 1/40* (2013.01); *B26F 1/44* (2013.01);
(Continued)

(58) Field of Classification Search
CPC .... B26F 1/384; B26F 1/14; B26F 1/40; B26F 1/44; B26F 1/02; B26F 1/08; B26F 1/18;
(Continued)

(56) References Cited

U.S. PATENT DOCUMENTS 3,373,643 A 3/1968 Maximilian
3,823,633 A * 7/1974 Ross ..... B26D 7/20 83/346
(Continued)

FOREIGN PATENT DOCUMENTS

DE 19502164 7/1995
GB 1303838 1/1973
(Continued)

OTHER PUBLICATIONS

Extended Search Report for European Application No. 16169772.7 dated Dec. 20, 2016 in 6 pages.
(Continued)

*Primary Examiner* — Omar Flores Sanchez
(74) *Attorney, Agent, or Firm* — Knobbe, Martens, Olson & Bear LLP

(57) ABSTRACT

The present disclosure relates to a cutting system for providing holes in a core material layer. The cutting system has a cutting tool having a cutting knife configured to cut through the core material layer, and an anvil having a rigid support surface for receiving the cutting knife of the cutting tool. The cutting system further has an elastic member that is positioned to absorb at least a part of a force applied when the cutting tool is pressed against said anvil.

15 Claims, 5 Drawing Sheets

(51) Int. Cl.

| | |
|---|---|
| ***B26F 1/40*** | (2006.01) |
| ***B26F 1/44*** | (2006.01) |
| *B26F 1/08* | (2006.01) |
| *B26F 1/20* | (2006.01) |
| *B26F 1/02* | (2006.01) |
| *B26F 1/18* | (2006.01) |

(52) U.S. Cl.
CPC . *B26F 1/02* (2013.01); *B26F 1/08* (2013.01); *B26F 1/18* (2013.01); *B26F 1/20* (2013.01); *B26F 2001/4409* (2013.01); *B26F 2001/4472* (2013.01)

(58) Field of Classification Search
CPC ..... B26F 1/20; B26F 2001/4409; B26F 2001/4472
See application file for complete search history.

(56) References Cited

U.S. PATENT DOCUMENTS

| | | | | |
|---|---|---|---|---|
| 4,073,208 | A * | 2/1978 | Kirkpatrick | B26D 7/20 492/53 |
| 4,289,055 | A | 9/1981 | Von Schriltz | |
| 5,047,607 | A * | 9/1991 | Briffod | B23H 7/108 219/69.12 |
| 5,471,901 | A * | 12/1995 | Nishiya | B21D 28/24 83/136 |
| 5,791,219 | A * | 8/1998 | Ochsner | B26D 7/2614 83/331 |
| 5,809,858 | A | 9/1998 | DeRoo, Sr. | |
| 6,203,482 | B1 | 3/2001 | Sandford | |
| 6,378,409 | B1 * | 4/2002 | Reid | B26D 5/02 270/58.07 |
| 9,636,835 | B2 * | 5/2017 | Buss | B26D 1/22 |
| 10,391,657 | B2 * | 8/2019 | Ferguson | B26F 1/20 |
| 2003/0079594 | A1 * | 5/2003 | Kemper | B26F 1/44 83/698.31 |
| 2006/0037452 | A1 * | 2/2006 | Grenier | B26D 1/405 83/469 |
| 2009/0100975 | A1 * | 4/2009 | Grenier | B26D 1/405 83/347 |
| 2011/0120283 | A1 * | 5/2011 | Serra Obiol | B26D 7/20 83/347 |
| 2012/0055305 | A1 * | 3/2012 | Betti | B26D 1/626 83/436.3 |
| 2012/0111166 | A1 * | 5/2012 | Yamada | B26D 7/1818 83/117 |
| 2012/0132047 | A1 * | 5/2012 | Iori | B26D 7/1818 83/136 |
| 2013/0036889 | A1 * | 2/2013 | Aichele | B26D 7/2628 83/343 |
| 2013/0094891 | A1 * | 4/2013 | Annerstedt | B26D 9/00 400/621 |
| 2014/0260438 | A1 * | 9/2014 | Matsumura | B26F 1/02 69/2 |
| 2016/0332315 | A1 * | 11/2016 | Sim | B26F 1/384 |
| 2017/0106555 | A1 * | 4/2017 | Yamamoto | A61F 13/15723 |
| 2017/0232632 | A1 * | 8/2017 | Warll | B26D 7/204 83/659 |
| 2018/0001505 | A1 * | 1/2018 | Smithwick, Jr. | B26F 1/384 |
| 2018/0036899 | A1 * | 2/2018 | Allen | B26F 1/44 |
| 2018/0178479 | A1 * | 6/2018 | Kellermann | B26F 1/44 |
| 2019/0152087 | A1 * | 5/2019 | Martensson | B26F 1/14 |
| 2019/0152182 | A1 | 5/2019 | Hedberg | |
| 2019/0176358 | A1 * | 6/2019 | Benko | B26D 7/204 |

FOREIGN PATENT DOCUMENTS

| | | |
|---|---|---|
| JP | H08-25297 | 1/1996 |
| RU | 2217298 | 11/2003 |
| SU | 1542706 | 2/1990 |

OTHER PUBLICATIONS

International Search Report and Written Opinion for Application No. PCT/EP2017/061618 dated Jul. 4, 2017 in 10 pages.
U.S. Appl. No. 16/302,042, Cutting Unit, Web of Packaging Material, and Method for Cutting Preparation Features into it, filed Nov. 15, 2018.
U.S. Appl. No. 16/301,570, A Cutting Tool, and a Method for Cutting a Web or Sheet of Material, filed Nov. 14, 2018.
Extended Search Report for European Application No. 16169773.5 dated Dec. 20, 2016 in 6 pages.
International Search Report and Written Opinion for Application No. PCT/EP2017/061616 dated Jun. 19, 2017 in 8 pages.
International Search Report for International Application No. PCT/EP2017/061617 dated Jun. 26, 2017 in 2 pages.
Written Opinion of the International Searching Authority for International Application No. PCT/EP2017/061617 dated Jun. 26, 2017 in 4 pages.

* cited by examiner

CUTTING SYSTEM, AND A METHOD FOR CUTTING A WEB OR SHEET OF MATERIAL

TECHNICAL FIELD

The present invention relates to the field of cutting preparation features in a web or sheet of material, such as in particular packaging materials, and in particular to a cutting system and cutting method for such packaging material.

BACKGROUND

It is commonly known to use a paperboard based packaging material to form product containers, such as containers for enclosing and storing liquid food.

In order to ensure the required quality of the final package, e.g. in terms of food safety and integrity, the packaging material may comprise different layers. As an example, a laminated packaging material may comprise a paperboard with at least one first plastic layer applied on one side thereof making up the outer surface of the final package, and a second plastic composition or layer on the opposite or inner side. The second plastic composition may in some cases be laminated to a protective layer such as an aluminum foil; the laminated material thus normally also includes an outer, or distal layer on the inner side, which is in contact with the product intended to be contained in the final package.

If the final package is to be provided with a cap or a closure, adjustments to the packaging material need to be made. It is known that before application of any additional layers to the paperboard, the paperboard is adapted to the later application of a cap by incorporation of a hole for that purpose. Another application requiring a hole to be made is e.g. packages having a straw hole.

Such holes are normally cut in the paperboard prior to lamination, i.e. before any polymeric layers are added to form the final packaging material. The cutting process is performed by operating a cutting tool, such as a punching knife to move against a mating anvil. During operation the paperboard to be cut is positioned between the punching knife, forming a male tool, and a rigid anvil surface.

In order to achieve a high precision cut it is of outmost importance to control the movement of the punching knife such that it does not cut through the paperboard and comes into contact with the anvil surface. Should there be a misalignment in the end position of the punching knife such that it in fact hits the anvil surface the punching knife and/or the anvil surface will eventually be damaged.

Manufacturing of packaging material is run at very high speeds, well over 400 meters per minute. In case of end position misalignment of the punching knife it is readily understood that a vast amount of packaging material will be wasted if the error is not detected in time.

In order to reduce the risk of waste of material and improve the cost effectiveness of the entire hole-cutting process, it is not unusual to spend more than one entire day to accomplish the required calibration and alignment of the punching knife movement.

In view of this, it would be desired to provide a more efficient and less sensitive cutting system at least partly overcoming the disadvantages of prior art systems.

SUMMARY

An object of the present invention is to solve the above-mentioned problems.

According to a first aspect, a cutting system for providing holes in a core material layer is provided. The cutting system comprises a cutting tool having a cutting knife configured to cut through the core material layer, and an anvil having a rigid support surface for receiving the cutting knife of the cutting tool. The cutting system further comprises an elastic member being positioned to absorb at least a part of a force applied when the cutting tool is pressed against said anvil.

The rigid support surface of said anvil may be arranged onto said elastic member. For this embodiment the elastic member is provided on the anvil of the cutting system which means that conventional (and stiff) cutting tools may be used.

In an embodiment the cutting knife extends from a rigid knife support. This is advantageous in that the cutting knife may be made integral with the knife support, whereby manufacturing and mounting of the cutting tool is greatly facilitated.

The rigid knife support of the cutting tool may be arranged onto the elastic member. This provides an alternative way of obtaining the same technical effect in terms of a more broad process window, increased life time and more cost-effective manufacturing of the cutting knife, and less sensitivity to vibrations and thermal expansions.

In an embodiment the cutting knife extends along a closed path, which is advantageous in that the cutting system may be used for providing holes or perforations in the core material layer. The closed path may e.g. have a circular shape, or other shapes such as elliptical, rectangular, triangular, etc.

The elastic member may be made of rubber, which is advantageous in that readily available materials can be used.

The cutting tool may be arranged on the outer surface of a cutting roller, and the anvil may be arranged on the outer surface of an anvil roller. By implementing the cutting system in a rotational system great production speed may be achieved.

One of the edge of the cutting knife and the rigid support surface of the anvil may be planar, and the other one of the cutting knife and the rigid support surface of the anvil may be convex. By providing one convex part the other part may be planar, which is particularly advantageous for embodiments in which the cutting knife is planar. This is due to the fact that it is far easier to manufacture a flat cutting knife.

In another embodiment the rigid support surface of the anvil is convex and having a radius, and the center of the anvil radius does not coincide with the center of a radius of the anvil roller. Improved cutting action is thus accomplished.

The cutting roller may be positioned relative the anvil roller such that the elastic member is compressed when the cutting knife contacts the rigid support surface of the anvil. The elastic member may be compressed by 0.02-0.1 mm, preferably by 0.06-0.08 mm, when the cutting knife contacts the rigid support surface of the anvil. This amount of compression has proven to be particularly advantageous for obtaining good results.

According to a second aspect a method for providing a core material layer with a through hole is provided. The method comprises arranging a core material layer onto a rigid support surface of an anvil, and pressing a cutting knife of a cutting tool against said core material layer such that the cutting knife comes into contact with the rigid support surface of the anvil when the core material layer is cut. The method is further performed such that the cutting tool or the anvil deforms when the cutting knife comes into contact with the rigid support surface.

According to a third aspect a method for providing a packaging material is provided. The method comprises providing a core material layer, providing said core material layer with at least one through hole by performing the method according to the second aspect described above, and laminating the cut core material layer to at least one polymeric layer, such that the polymeric layer covers the whole core layer including the cut hole.

SHORT DESCRIPTION OF THE DRAWINGS

FIGS. 1*a-c* are schematic views of a punching process according to prior art.

FIGS. 2*a-c* are schematic views of a cutting process using a cutting system according to an embodiment.

Figure 5A:
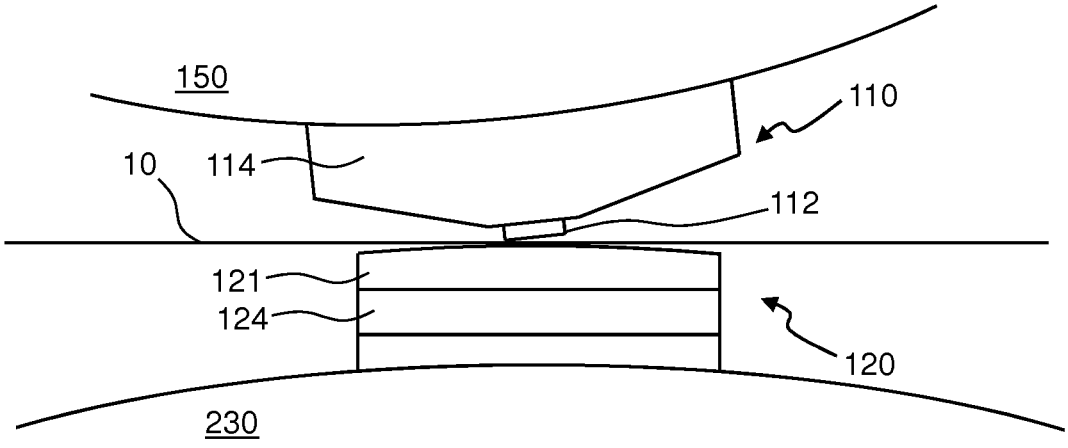
Figure 5B:
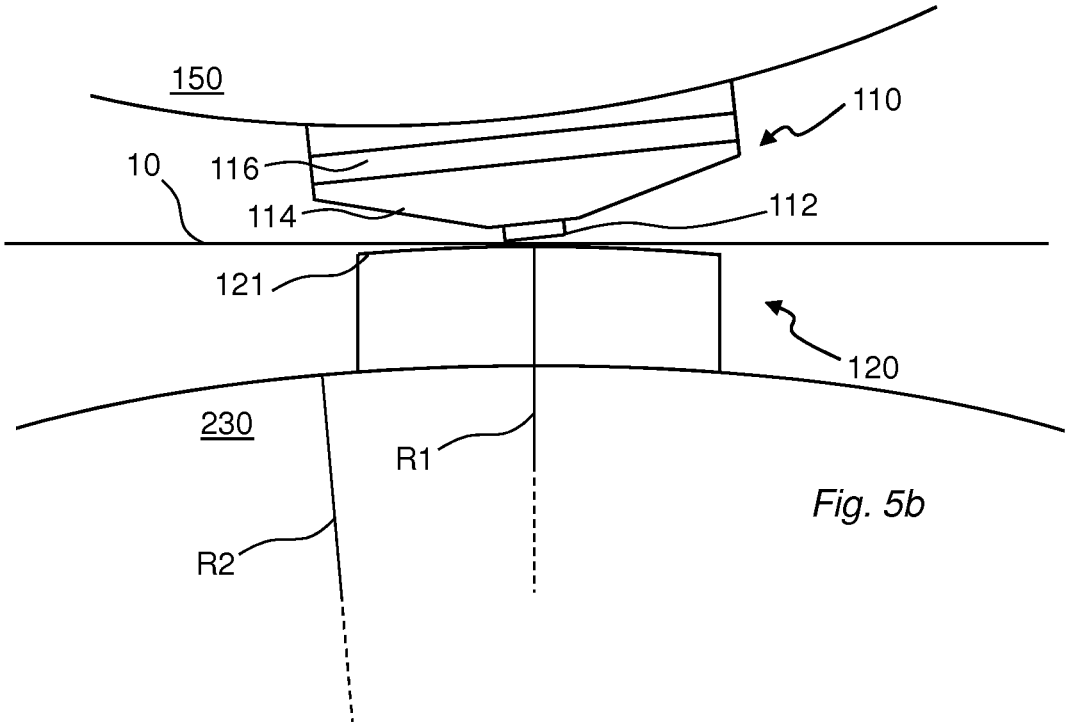

FIGS. 5*a-b* are cross-sectional views of a cutting system according to different embodiments.

Figure 6:
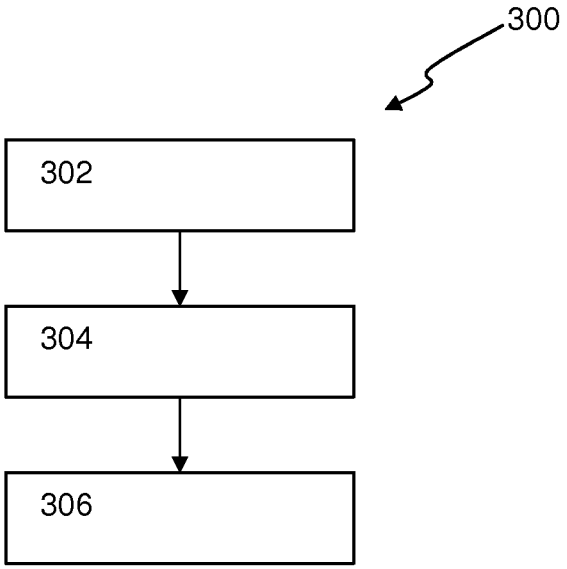

FIG. 6 is a schematic view of a method according to an embodiment.

DETAILED DESCRIPTION

Figure 1A:
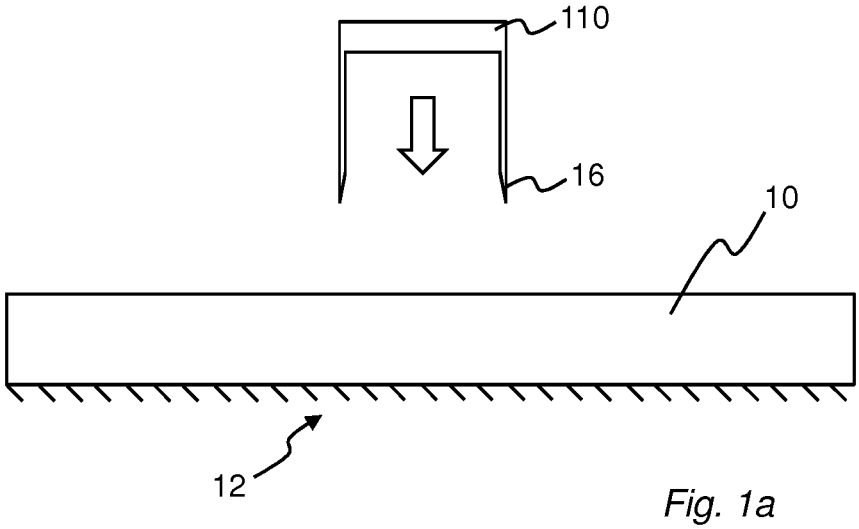
Fig. 1a Prior Art
Figure 1B:
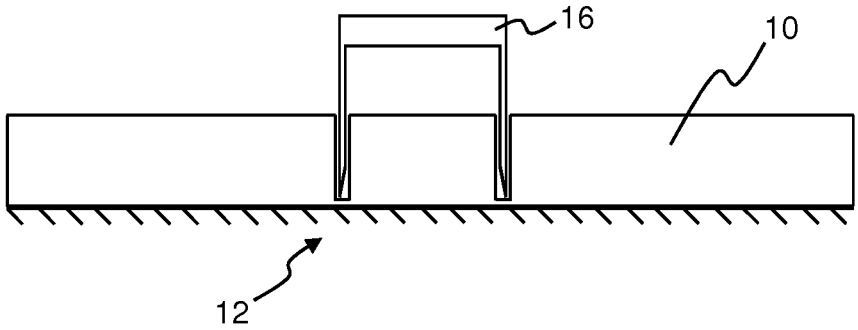
Fig. 1b Prior Art
Figure 1C:
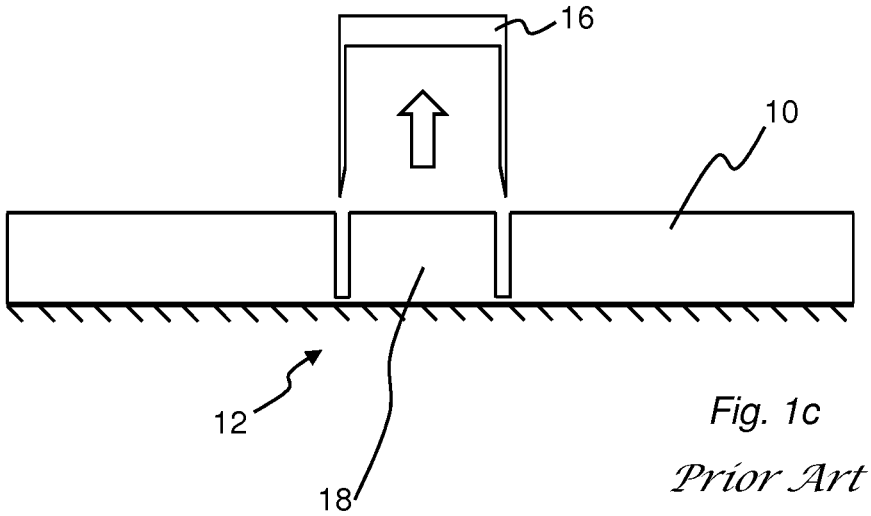
Fig. 1c Prior Art

Starting in FIGS. 1*a-c*, a general method for providing a core material layer 10 with a through hole according to prior art will be described. In FIG. 1*a* the core material layer 10 is arranged onto a rigid support surface 12. The support surface 12, e.g. being formed by a metal is either planar or slightly curved in case it forms part of an anvil roller. A male punching tool 16 is provided for cutting the core material layer 10. As the male punching tool 16 moves downwards and towards the core material layer 10 it will cut through the core material layer 10 until the downwards movement is stopped. At this point, best illustrated in FIG. 1*b*, the cutting edge of the male punching tool 16 is located slightly above the rigid support surface of the anvil 12. This position is set extremely accurately for avoiding any direct contact between the punching tool 16 and the rigid support surface, as such contact will lead to damage of the punching tool 16, the anvil 12, or both. Typically, the vertical distance between the punching tool 16 and the anvil 12 is 0.005-0.03 mm such that only a very small force is required for removing the cut-out portion 18. As the punching tool 16 retracts upwards the cut portion 18 may be ejected by any suitable means. As is clear from FIGS. 1*a-c*, calibration of the relative movement between the punching tool 16 and the anvil 12 is crucial.

Now turning to FIGS. 2*a-c*, an improved cutting system 100 according to an embodiment will be described. The cutting system 100 comprises a cutting tool 110 having a cutting knife, or edge 112 configured to cut through the core material layer 10. Relative movement between the cutting tool 110 and the core material layer 10 is provided e.g. by arranging the cutting tool 110 on a movable support structure, such as a rotating roller.

For providing circular holes in the core material layer 10 the cutting knife 112 may be circular, meaning that the cutting knife 112 forms a circular shaped distal circumference of the cutting tool 110. Other shapes of the cutting knife 112 are however also possible within the context of the embodiments described herein, such as straight or curved slits or perforation lines. It is to be understood that the cutting system 100 as described herein may provide advantages for various kinds of hole shapes, such as circular, rectangular, triangular, elliptical, etc. Moreover, the distal circumference of the cutting tool may include spaced-apart ridges such that the cutting operation will not result in an evenly cut hole, but rather a perforation of the core material layer.

Figure 2A:
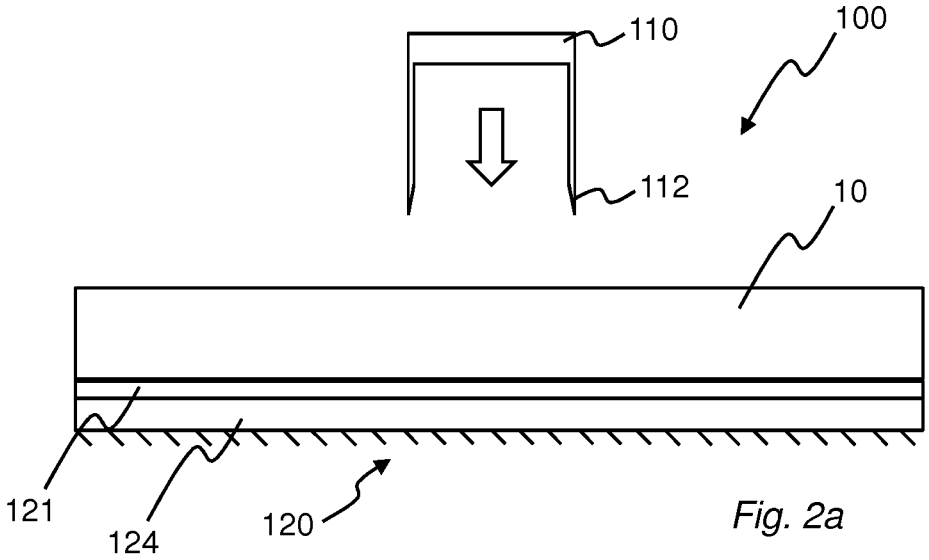
Figure 2B:
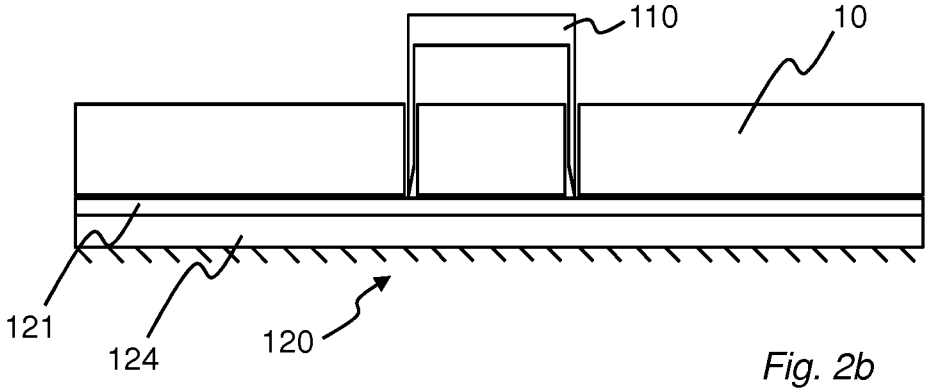

As the cutting tool 110 is moving downwards and towards the core material layer 10 the cutting knife 112 will engage with the core material layer 10, best illustrated in FIG. 2*b*. Here the cutting tool 110 will provide a punching action to the core material layer 10 which will result in a penetration of the cutting knife 112 into the core material layer 10.

The relative movement between the cutting knife 112 and the core material layer 10 is continuing until the entire core material layer thickness is cut, at which point the cutting knife 112 will contact a rigid support surface 121 of an anvil 120.

For preventing any damage of the cutting knife 112 and/or the rigid support surface 121 of the anvil 120, an elastic member 124 is arranged underneath the rigid support surface 121 such that the rigid support surface 121 is allowed to move, or flex, downwards as the elastic member 124 is compressed in response to the pressing force applied by the cutting tool 110.

The elastic member 124 may e.g. be made of vulcanized rubber, and the deformation may be in the range of 0.01-0.10 mm in a normal direction of the support surface 121.

This means that the anvil 120 provides a rigid support surface 121 for enabling a nice cut completely through the core material layer, and the risk for any damage is greatly reduced due to the provision of the elastic member 124.

Figure 2C:
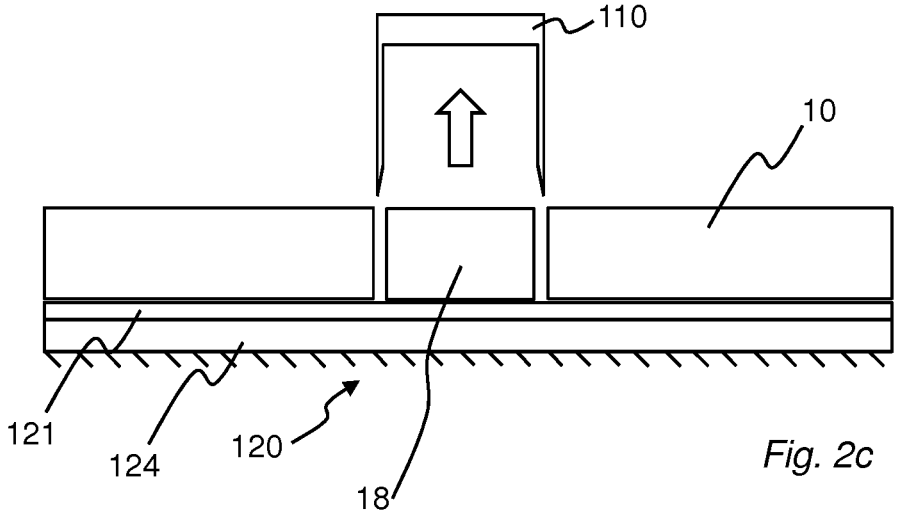

When cutting is finished, the pressing force from the cutting tool 110 is removed and the cutting tool is moved upwards as can be seen in FIG. 2*c*. Consequently, a cut portion 18 may be removed from the core material layer 10.

Figure 3:
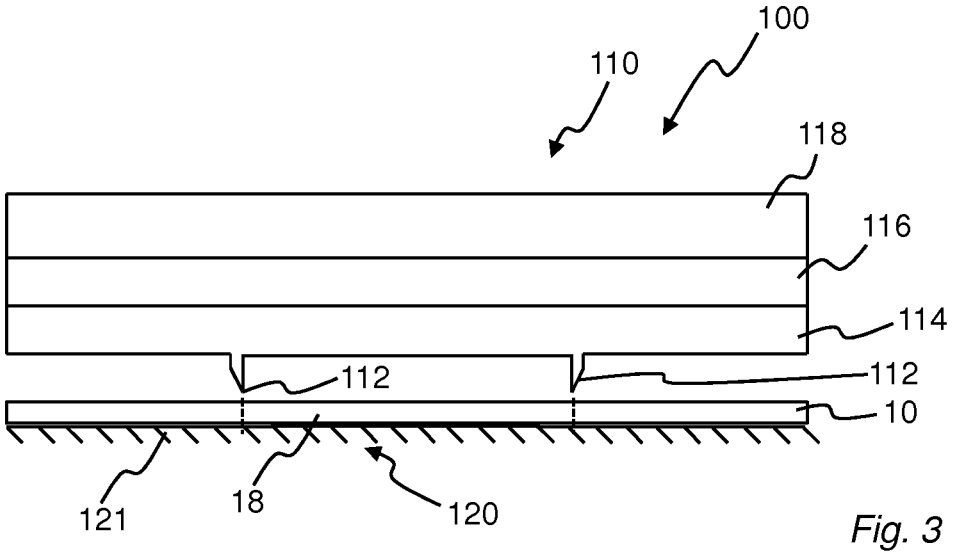
FIG. 3 is a cross-sectional view of a cutting system according to an embodiment.

In FIG. 3 a schematic cross-section of a cutting tool 110 is shown. The cutting tool 110 forms part of a cutting system 100 according to an alternative embodiment. The cutting tool 110 includes a cutting knife 112 having a shape so that the entire hole is cut at the same time as the cutting knife 112, forming the periphery of the cutting tool 110, engages with the core material layer 10. As mentioned previously the circumference of the cutting knife may have a circular shape, a triangular shape, a rectangular shape, an elliptical shape, etc.

As a result a part 18 (see FIG. 2*c*) of the core material layer 10 will be cut from the core material layer 10.

The cutting knife 112 projects outwards (seen as the downward direction in FIG. 3), towards the core material layer 10 to be cut, from a rigid knife support 114. The rigid knife support 114 and the cutting knife 112 are preferably made of the same material as an integral piece. The material may e.g. be a metal such as steel.

As can be seen in FIG. 3 the anvil 120 has no elastic member supporting the rigid support surface 121; instead the elastic member of the cutting system 100 is formed as an elastic member 116 of the cutting tool 110. The elastic member 116 is thus positioned above the rigid knife support 114, e.g. between the rigid knife support 114 and a base member 118. This means that the elastic member 116 is arranged on a side of the rigid knife support 114 being opposite the side of the rigid knife support 114 facing the core material layer 10.

Hence, when the cutting knife 112 comes into contact with the rigid support surface 121 of the anvil 120 the elastic member 116 of the cutting tool 110 will dampen the pressing force from the cutting knife 112 whereby damages to the cutting tool 110 and/or the anvil 120 will be reduced in the same manner as for the cutting system 100 described with reference to FIGS. 2*a-c*.

Figure 4:
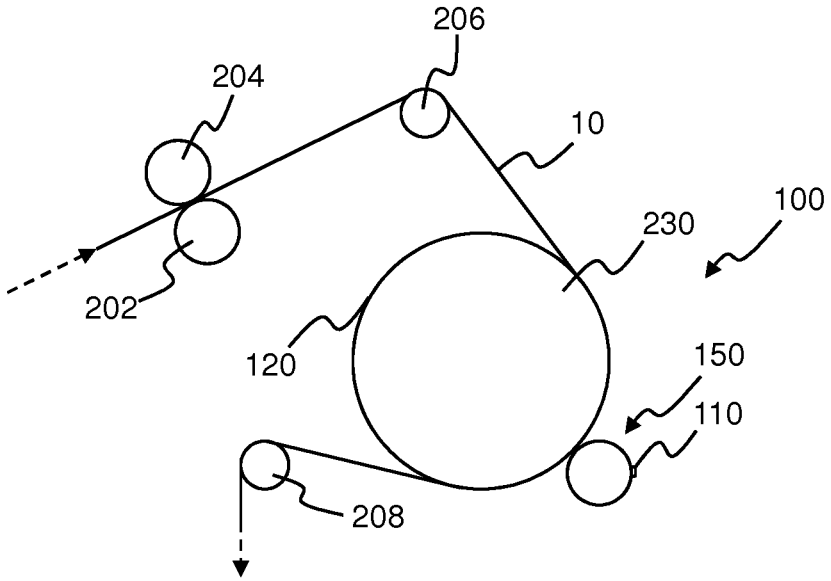
FIG. 4 is a schematic view of a cutting system according to an embodiment.

Now turning to FIG. 4 a cutting system 100 according to an embodiment is shown. The cutting system 100 is particularly advantageous for high speed applications, and the cutting system 100 comprises a cutting roller 150 having a cutting tool 110 attached to it. The roller 150 is configured to rotate against an anvil 120 in the form of an anvil roller 230. The anvil 120 has a rigid outer surface. A web of a core material layer 10, which will later be described to form part of a packaging material, is fed through the cutting system 100 via one or more guiding rollers 202, 204, 206, 208. Preferably, the diameter of the anvil roller 230 is substantially larger than the diameter of the cutting roller 150 in order to allow the part 18 (see e.g. FIG. 2*c*) to be cut from the core material layer 10 to be substantially planar when the cutting tool 110 engages with the core material layer 10. Hence, as the cutting roller 150 is rotating against the anvil roller 230 the cutting tool 110 will periodically come into contact with the core material layer 10, whereby a hole is cut out from the core material layer 10.

For the embodiment described above the elastic member may either form part of the anvil 120 as shown in FIGS. 2*a-c*, or of the cutting tool 110 as shown in FIG. 3.

In FIG. 5*a* another embodiment of a cutting system is shown. Here, the cutting tool 110 is positioned onto the cutting roller 150 as an insert whereby the knife support 114 is attached to the outer surface of the cutting roller 150. As is evident, the cutting roller 150 may have several cutting tools 110 attached to it, either having the same dimensions or not. As the cutting tool 110 is entirely rigid, the elastic member is for this embodiment provided in the anvil 120.

The anvil 120 is positioned onto the anvil roller 230 as an insert, positioned such that the anvil 120 will receive contact with a cutting tool 110 when the anvil roller 230 and the cutting roller 150 rotates against each other. The elastic member 124 is positioned underneath the rigid support surface 121 of the anvil 120. When the cutting knife 112 cuts through the core material layer 10, it will press on the rigid support surface 121 which will be allowed to deflect due to the provision of the elastic member 124 in accordance with the description above.

In FIG. 5*b* a similar embodiment is shown, however the anvil 120 is in this embodiment entirely rigid while the cutting tool 110 has an elastic member 124 in a manner being similar to the cutting tool 110 described with reference to FIG. 3. Hence, the elastic member 116 is positioned to support the knife support 114.

As can be seen in FIGS. 5*a-b* the cutting knife 112 has a planar shape, i.e. the circumferential cutting edge of the cutting knife 112 extends in a common plane. This allows for a far more cheaper manufacturing of the cutting tool 110 compared to alternatives involving a curved cutting knife 112. Due to the rotational movement of the cutting knife 112, the rigid support surface 121 of the anvil 120 has a convex configuration for compensating for the flat, or planar cutting knife 112. As the rigid support surface 121 of the anvil 120 is convex it will exhibit a radius R1. The anvil roller 230 will also have a radius R2 due to its cylindrical shape. In a preferred embodiment the center of the anvil radius R1 does not coincide with the center of a radius R2 of the anvil roller 230, i.e. the radius R1 is not having the same length as the radius R2.

When the cutting tool 110 is pressed downwards against the anvil 120 due to rotation of the rollers 150, 230, the elastic member 124 is typically compressed in the range of 0.06-0.08 mm. In particular the deformation of the elastic member allows for a wider process window, and the cutting system 100 has proven to be less sensitive for vibrations and thermal expansion.

The cutting system described above has proven to be particularly advantageous for high speed operation, where a web speed of above 400 meters per minute is utilized. Still for this high speed accurate cutting is accomplished.

Now turning to FIG. 6 a method 300 for providing a core material layer with a through hole is will be described. The method 300, shown schematically only, includes a first step 302 of arranging a core material layer onto a rigid support surface of an anvil and a second step 304 of pressing a cutting knife of a cutting tool against said core material layer such that the cutting knife comes into contact with the rigid support surface of the anvil when the core material layer is cut. During step 304 the cutting tool or the anvil deforms when the cutting knife comes into contact with the rigid support surface. Preferably, the cutting tool and the anvil form part of a cutting system as described above with reference to FIGS. 2-5.

The method 300 may also include a subsequent step 306 in which the cut core material layer is provided with at least one polymeric layer. In such embodiment, the method 300 is not only performed for providing a core material layer with a through hole, but for actually providing a laminated packaging material.

In one embodiment, the side of the core material layer 10 at which the cutting tool 110 is engaged may be the side onto which subsequent layers are applied first to form a packaging material.

The packaging material thus comprises a core material layer, an outer layer, and an inner layer, wherein the outer layer and inner layers are applied to opposite sides of the core material layer after the at least one hole is cut.

The outer layer applied to one side of the core material layer is adapted to provide the outer surface of a package to be produced, which outer surface and outer layer faces the surroundings of the package. The inner layer is applied to the other side of the core material layer and is adapted to provide the inner surface of a package to be produced which is in contact with the material contained in the package.

The core material layer may be a sheet for providing rigidity to the packaging material, and may preferably be made of core material or cardboard.

The outer layer may comprise at least one layer of polymer material, which is applied to the core material layer. Moreover, one of the layers making up the outer layer may be a decorative layer making up the outer surface of the packaging to be formed.

A printing layer may be included onto the core material layer, adjacent to the outer layer.

The inner layer may comprise at least one layer of polymer material.

A protective layer may be present between the core material layer and the inner layer. The protective layer may be a foil, such as a metal foil, preferably an aluminium foil. The protective layer protects against oxygen to maintain the nutritional value and flavours of the food in the package at ambient temperatures.

In addition, a lamination layer may be present between the protective layer and the core material layer. The lamination layer may be at least one layer of polymer material.

According to one embodiment, the layers of the packaging material intended for the inside of a finished package, which is in contact with the material contained in the package comprises starting from the core material layer: a lamination layer, a protective layer and an sealing layer. The lamination layer enables the core material to adhesively bond to any protective layer applied. The sealing layer enables package sealing by heat welding of opposite surfaces of the sealing layer together.

The polymer layers of the packaging material may be any type of polymer material, preferably a plastic material such as polyethylene.

Different types of containers may be obtained from the packaging material. A packaging material or a container according to the present invention may be used for foodstuffs which preferably may be liquid.

The invention claimed is:

1. A cutting system for providing holes in a core material layer, comprising:

a cutting tool having a cutting knife configured to cut through the core material layer, wherein a cutting edge of the cutting knife extends to a common plane;

an anvil having a rigid support surface configured to receive the cutting knife of the cutting tool;

wherein the cutting system further comprises an elastic member positioned to absorb at least a part of a force applied when the cutting tool is pressed against said anvil;

wherein the rigid support surface of said anvil is arranged onto said elastic member;

wherein the cutting knife is arranged on an outer surface of a cutting roller and the anvil is arranged on an outer surface of an anvil roller; and wherein the rigid support surface of said anvil comprises a radius with a center that does not coincide with a center of a radius of the outer surface of the anvil roller.

2. The cutting system according to claim 1, wherein the cutting knife extends from a rigid knife support of said cutting tool.

3. The cutting system according to claim 2, wherein said rigid knife support of said cutting tool is arranged onto a knife support elastic member.

4. The cutting system according to claim 1, wherein said cutting knife extends along a closed path.

5. The cutting system according to claim 4, wherein said closed path comprises a circular shape.

6. The cutting system according to claim 1, wherein the elastic member is made of rubber.

7. The cutting system according to claim 1, wherein the rigid support surface of the anvil is convex.

8. The cutting system according to claim 1, wherein the cutting roller is positioned relative the anvil roller such that the elastic member is compressed when the cutting knife contacts the rigid support surface of the anvil.

9. The cutting system according to claim 8, wherein the elastic member is compressed by 0.02-0.1 mm when the cutting knife contacts the rigid support surface of the anvil.

10. A method for providing a core material layer with a through hole, comprising:

arranging a core material layer onto a rigid support surface of an anvil that is arranged on an outer surface of an anvil roller, the anvil positioned over only a portion of a circumference of the anvil roller and the rigid support surface of the anvil arranged onto an elastic member; and pressing a cutting knife of a cutting tool that is arranged on an outer surface of a cutting roller against said core material layer such that the cutting knife comes into contact with the rigid support surface of the anvil when the core material layer is cut, whereby the anvil elastically deforms when the cutting knife comes into contact with the rigid support surface, and wherein a cutting edge of the cutting knife extends to a common plane.

11. A method for providing a packaging material, comprising:

providing said core material layer with at least one through hole by performing the method according to claim 10; and providing the cut core material layer with at least one polymeric layer.

12. The cutting system according to claim 3, wherein the elastic member and knife support elastic member are made of rubber.

13. The cutting system according to claim 8, wherein the elastic member is compressed by 0.06-0.08 mm when the cutting knife contacts the rigid support surface.

14. The cutting system of claim 1, wherein the common plane is spaced away from the outer surface of the cutting roller.

15. The cutting system of claim 1, wherein the common plane is parallel to an axis extending through a center of the cutting roller.

* * * * *